US008851642B2

(12) United States Patent
McCallum et al.

(10) Patent No.: US 8,851,642 B2
(45) Date of Patent: Oct. 7, 2014

(54) INK DELIVERY SYSTEM FOR INKJET PRINTHEADS

(71) Applicant: Delphax Technologies Inc., Bloomington, MN (US)

(72) Inventors: Robert McCallum, Caledon (CA); Christopher Thomson, Etobicoke (CA); Bentzi Tilayof, Richmond Hill (CA)

(73) Assignee: Delphax Technologies Inc., Bloomington, MA (US)

( * ) Notice: Subject to any disclaimer, the term of this patent is extended or adjusted under 35 U.S.C. 154(b) by 0 days.

(21) Appl. No.: 13/886,023

(22) Filed: May 2, 2013

(65) Prior Publication Data

US 2013/0293640 A1 Nov. 7, 2013

Related U.S. Application Data

(60) Provisional application No. 61/642,310, filed on May 3, 2012.

(51) Int. Cl.
*B41J 2/175* (2006.01)
*B41J 3/60* (2006.01)

(52) U.S. Cl.
CPC ..... *B41J 2/17596* (2013.01); *B41J 2/17553* (2013.01); *B41J 2/17513* (2013.01); *B41J 3/60* (2013.01); *B41J 2/17523* (2013.01); *B41J 2/175* (2013.01); *B41J 2/17509* (2013.01)
USPC ..... 347/85; 347/84

(58) Field of Classification Search
USPC ..... 347/4, 7, 84, 85, 86, 87, 89
See application file for complete search history.

(56) References Cited

U.S. PATENT DOCUMENTS

| | | | | |
|---|---|---|---|---|
| 4,282,536 | A * | 8/1981 | Paschen et al. | 346/140.1 |
| 4,342,042 | A | 7/1982 | Cruz-Uribe et al. | |
| 4,694,307 | A * | 9/1987 | Toganoh et al. | 347/85 |
| 4,734,711 | A * | 3/1988 | Piatt et al. | 347/17 |
| 4,929,963 | A | 5/1990 | Balazar | |
| 5,592,203 | A * | 1/1997 | Thiel et al. | 347/40 |
| 5,956,062 | A * | 9/1999 | Omata et al. | 347/89 |
| 6,139,136 | A * | 10/2000 | Mackay et al. | 347/85 |
| 6,196,668 | B1 * | 3/2001 | Bode | 347/85 |
| 6,840,604 | B2 * | 1/2005 | Kimura et al. | 347/85 |
| 8,322,832 | B2 * | 12/2012 | Emerton et al. | 347/85 |
| 2009/0322831 | A1 | 12/2009 | Emerton et al. | |

FOREIGN PATENT DOCUMENTS

WO 9744194 A1 11/1997

* cited by examiner

*Primary Examiner* — Anh T. N. Vo
(74) *Attorney, Agent, or Firm* — Stuart L. Wilkinson

(57) ABSTRACT

An ink delivery system for an inkjet printer has an ink supply tank and a pair of printheads located at different heights. A primary ink delivery circuit delivers ink to a pair of intermediate tanks, each tank maintained a precise distance below a respective one of the printheads. Ink is pumped to the higher tank to the level of a weir and overflowing ink flows under gravity to the lower tank. The overflowing ink fills the lower tank to the level of a weir and overflowing ink returns to the supply tank. Secondary ink delivery circuits have capillary lines for supply of ink from each of the intermediate tanks to the respective printhead. Ink is maintained in the supply lines ready for inkjet printing by establishing a negative pressure between each intermediate tank and the respective printhead.

15 Claims, 3 Drawing Sheets

INK DELIVERY SYSTEM FOR INKJET PRINTHEADS

CROSS REFERENCE TO RELATED PATENTS

The present U.S. Utility Patent Application claims priority pursuant to 35 U.S.C. §119(e) to U.S. Provisional Patent Application Ser. No. 61/642,310, entitled "INK DELIVERY SYSTEM FOR INKJET PRINTHEADS" filed May 3, 2012.

FIELD OF THE INVENTION

This invention relates to an ink delivery system for inkjet printheads and is particularly suitable for effecting double sided printing onto cut paper sheets or a paper web in industrial grade printers.

BACKGROUND OF THE INVENTION

In known arrangements for double sided printing of a continuous web or cut sheet medium such as paper, the medium is typically transported in a transport direction past successive printing stations. One surface of the sheet medium is printed at the first printing station and the medium is then passed through a radiant dryer to dry the applied ink and the underlying paper substrate, and then a cooler to cool the medium and to make its reverse surface receptive for printing. The reverse surface of the dried, cooled web or cut sheet is then printed at the second printing station. For speed and ease of handling, the one surface of the medium is printed from above while the reverse surface of the medium is printed from below. Such an arrangement is not effective for inkjet printing because droplets from an inkjet printhead can only really be accurately and consistently applied if ink from the printhead is directed downwardly so that the droplets are subjected to a combination of an ejection pressure to eject them from the printhead nozzles coupled with the application of gravity as the droplets travel from the nozzles to the medium.

SUMMARY OF THE INVENTION

According to one aspect of the invention, there is provided an ink delivery system for an inkjet printer comprising an ink supply tank, first and second inkjet printheads located at different heights; first and second intermediate tanks located at different heights respectively below the heights of the first and second inkjet printheads, a pump for pumping ink from the supply tank into the first intermediate tank, a first level setting device for limiting ink pumped into the first intermediate tank to a first level and for directing additional ink pumped into the first intermediate tank to a first overflow region, a first ink supply line for supplying ink from the first intermediate tank to a first inkjet printhead, an ink transfer line for transferring the overflow ink under gravity from the first overflow region to the second intermediate tank, and a second ink supply line for supplying ink from the second intermediate tank to a second inkjet printhead.

Preferably, the level setting device comprises a weir in the first intermediate tank. The second intermediate tank can have a second level setting device for limiting ink entering into the second tank through the ink transfer line to a second level and for directing additional ink entering the tank back to the supply tank. Preferably, the first level is a predetermined height below the height of nozzles of the first printhead whereby to establish a predetermined negative pressure in ink contained in the first printhead nozzles. Similarly, the second level can be a predetermined height below the height of nozzles of the second printhead whereby to establish a predetermined negative pressure in ink contained in the second printhead nozzles. The pump is preferably a peristaltic pump.

The ink delivery system can further comprise a first ink return line permitting ink flow from an exit port of the first printhead to the first intermediate tank, and a second ink return line permitting ink flow from an exit port of the second printhead to the second intermediate tank. The printheads are preferably one of a thermal drop-on-demand printhead and a piezoelectric drop-on-demand printhead.

The first and second inkjet printheads are preferably mounted in a sheet medium transport mechanism for presenting a first surface of the sheet medium to the first inkjet printhead and for presenting a reverse surface of the sheet medium to the second inkjet printhead. Preferably, the transport mechanism is operable to constrain media transported therethrough to an S-form locus the S-form locus having first and second generally horizontal spans for transporting the media successively in opposite direction with the media turned between the first and second spans, the first printhead positioned to print on media transported at the second span and the second printhead positioned to print on media transported at the first span.

The printer can have a plurality of the ink delivery systems forming a multi-ink delivery system, the first and second printheads being common to the plurality of ink delivery systems of the multi-ink delivery system, each ink delivery system operable to feed to the printheads a respective one of a plurality of different inks, each ink delivery system feeding a respective subset of nozzles of the first and second inkjet printheads.

The printer can have a plurality of the first inkjet printheads at one height and a plurality of the second printheads at a different height, each ink delivery system having a respective one of the plurality of first inkjet printheads and a respective one of the plurality of second inkjet printheads, the plurality of inkjet printheads at each height operable to print a composite image.

According to another aspect of the invention, there is provided a method of delivering ink to an inkjet printer comprising pumping ink from a supply tank to a first intermediate tank to establish a level of the ink in the first intermediate tank at a first height, establishing an ink path between ink in the first intermediate tank and nozzles at a first inkjet printhead mounted at a second height to establish a predetermined negative pressure of the ink at the nozzles of the first printhead, directing overflow ink entering the first intermediate tank into an overflow ink transfer path to direct overflow ink under gravity to a second intermediate tank and establishing a level of the ink in the second intermediate tank at a third height, and establishing an ink path between ink in the second intermediate tank and nozzles at a second inkjet printhead mounted at a fourth height to establish a predetermined negative pressure of the ink at the nozzles of the second inkjet print head.

Preferably, the method further comprises pumping the ink from the supply tank to the first intermediate tank using a peristaltic pump. The method can further comprise directing overflow ink entering the second intermediate tank to an overflow ink transfer path to direct overflow ink under gravity back to the supply tank. The method can further comprise feeding a sheet medium past the first inkjet printhead, operating the first inkjet printhead to print an image down onto one surface of the sheet medium, turning the sheet medium, feeding the sheet medium past the second inkjet printhead, and operating the second inkjet printhead to print an image down onto the reverse surface of the sheet medium.

The method can further comprise establishing the levels of the ink in the first and second intermediate tanks respectively at the first and third heights using respective weirs. The method can be performed on a plurality of inks to deliver the inks to successive ones of the first and second printheads at nozzles of the printheads dedicated to respective ones of the inks, the method in respect of each ink utilizing a supply tank, a first and second intermediate tank and related interconnection conduits unique to the respective ink.

BRIEF DESCRIPTION OF THE DRAWINGS

For simplicity and clarity of illustration, elements illustrated in the following figures are not drawn to common scale. For example, the dimensions of some of the elements are exaggerated relative to other elements for clarity. Advantages, features and characteristics of the present invention, as well as methods, operation and functions of related elements of structure, and the combinations of parts and economies of manufacture, will become apparent upon consideration of the following description and claims with reference to the accompanying drawings, all of which form a part of the specification, wherein like reference numerals designate corresponding parts in the various figures, and wherein:

DETAILED DESCRIPTION OF THE INVENTION INCLUDING THE PRESENTLY PREFERRED EMBODIMENTS

Figure 1:
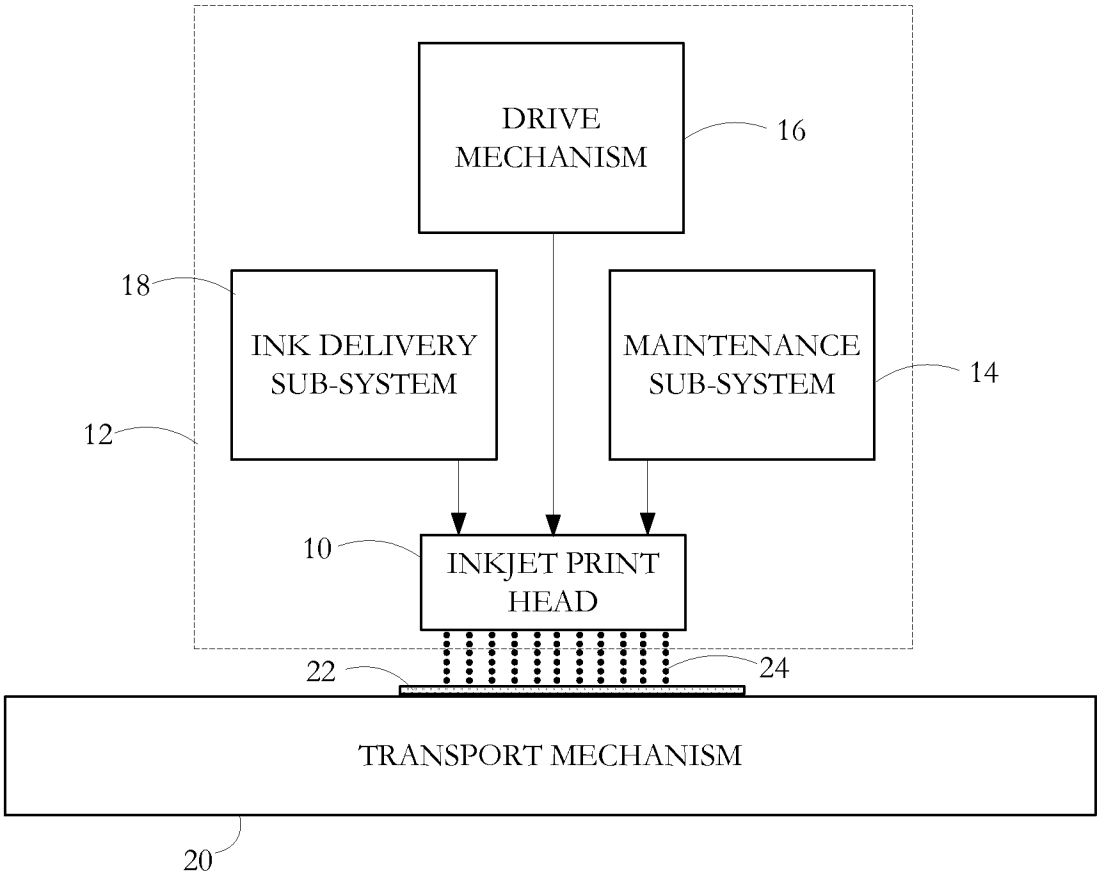
FIG. 1 is a schematic view of the primary elements of an industrial grade inkjet printer.

As shown schematically in FIG. 1, inkjet printers typically include an inkjet printhead 10 which is mounted in an inkjet print engine 12, the print engine 12 including ancillary subsystems such as a maintenance sub-system 14 for keeping the inkjet printhead 10 in good operating condition, and a drive mechanism 16 for moving the printhead into and out of a printing position. The printer also includes an ink delivery sub-system 18 for delivering ink to the printhead 10 and a transport mechanism 20 for transporting a sheet medium 22 to the printhead 10 for printing, and away from the printhead 10 after printing is completed. In use, the printhead 10 is operable to eject droplets 24 of ink or other jettable fluid onto the sheet medium 22 which may be a web or cut sheet medium such as paper.

Inkjet printheads are non-contact heads which transfer minute "flying" ink droplets over a short distance of the order of ½ to 1 millimeter. Ink jet printers are generally of the continuous type or the drop-on-demand type. In the continuous type, ink is pumped along conduits from ink reservoirs to nozzles. The ink is subjected to vibration to break the ink stream into droplets, with the droplets being charged so that they can be controllably deflected in an applied electric field. In a thermal drop-on-demand type, the ink is subjected to rapid heating of a small volume of ink to form a vapor bubble which expels a corresponding droplet of ink. In piezoelectric drop-on-demand printers, a voltage is applied to change the shape of a piezoelectric material and so generate a pressure pulse in the ink and force a droplet from the nozzle. In this specification, any reference to an ink will be understood also to encompass any ink jettable fluid suitable for use in an ink jet printer. This may be a fluid which is not usually thought of as an ink but which may be used in the course of the printing process to improve image quality, to improve the handling of printing materials, or for other reasons, such materials including, for example, primer and water.

Of particular but not exclusive interest in the context of the present invention are thermal drop-on-demand inkjet printheads commercially available under the MEMJET registered trade mark. Such printheads use thermal energy to produce a vapor bubble in ink occupying a channel so as to expel an ink droplet from a nozzle at an exposed end of the channel. The printhead is manufactured as an integrated circuit device to include heating resistors located adjacent the ink ejection nozzles, the resistors being individually energized by electrical heating pulses in response to an input print signal. For each ink color or type, the printhead has an ink inlet port, an ink outlet port and a main channel. Ink is drawn from the main channel into branch channels to enable printing by "firing" selected nozzles at a nozzle plate forming the printhead active face. Ink can be drawn continuously out of the printhead main channel and back to the respective ink container by the action of the peristaltic pump. However, usually, during printing, this flow is shut off. Ink is drawn up by capillary action in the channels of the printhead, and the negative hydrostatic pressure arrangement serves to retain the ink inside the printhead nozzle orifices, so preventing flooding of ink out onto the nozzle plate. The MEMJET printheads have a high nozzle density of the order of 1600 dots per inch (dpi). A series of such integrated circuit devices may be combined to provide a page wide printhead typically having five color channels. Typically, the preferred MEMJET integrated circuit printhead has of the order of 70,000 nozzles. At paper speeds up to of 350 mm (13.8 inches) per second, the printhead produces 1600×800 dpi quality, while at a (maximum) speed of 175 mm (6.9 inches) per second, the printhead produces 1600×1600 dpi output for high-quality graphics. Ink drop placement is very accurate with ink drops being of the order of 14 microns in diameter or 1-2 picoliters in volume. Typically a MEMJET IC chip contains 5 ink channels with two rows of nozzles per channel. Preferred Memjet devices have a nozzle plate coated with a layer of silicon nitride to provide a smooth, flat surface resisting debris adhesion and so providing for ease of maintenance.

Figure 2:
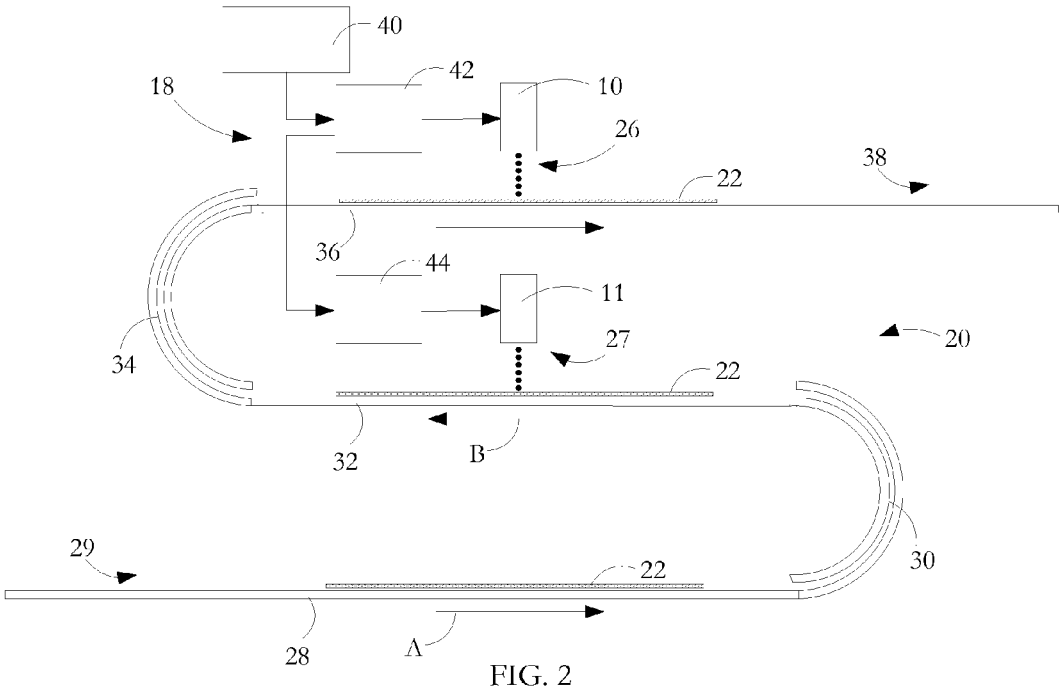
FIG. 2 is a part schematic view of an ink delivery system according to an embodiment of the invention, shown in relation to an associated sheet medium transport mechanism.

For industrial grade, high throughput printers, each of the paper transport mechanism 20, the ink delivery sub-system 18, and the print engine 12 must be designed for high throughput operation. Referring in detail to FIG. 2, there are illustrated parts of an ink jet printer having a paper transport mechanism 20 and a pair of inkjet printing stations 26, 27 which are supplied with ink by an ink delivery sub-system 18. The paper transport mechanism 20 is generally as disclosed by one embodiment of transport mechanism described in co-pending U.S. patent application Ser. No. 13/439,909 (Registration and transport unit for a sheet feeder), the disclosure of which application is incorporated herein by reference in its entirety. The exemplary transport mechanism includes a lower span 28 for transporting sheets 22 introduced at an entry zone 29 in the direction A, a turning unit 30 for turning the cut sheets 22 through a 180 degree turn, and a middle span 32 for transporting the turned sheets in a direction B opposite to direction A. At a second turning unit 34, the sheets 22 are turned back through a 180 degree turn, and then transported on a top span in the direction A to an exit zone 38.

Figure 3:
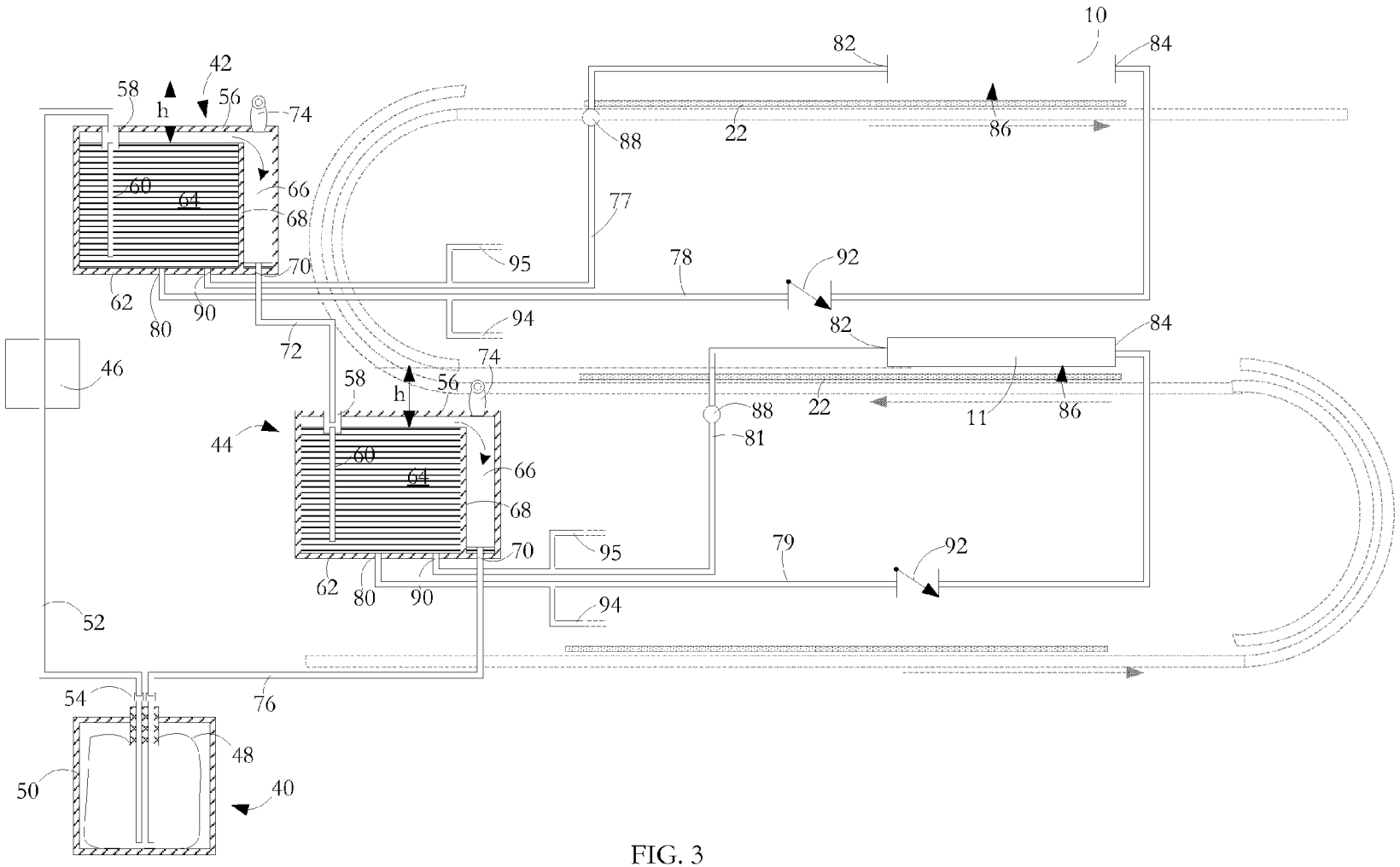
FIG. 3 is a part schematic, part sectional view of an ink delivery system according to an embodiment of the invention, shown superimposed on an associated sheet medium transport mechanism.

During their passage through the transport mechanism 20, the cut sheets 22 are printed on both sides—so-called duplex printing—with a first surface of the sheet printed at the printing station 27 and the reverse surface of the sheet printed at the printing station 26. Each printing station has a bank of closely spaced inkjet printheads, each individual printhead having rows of ink nozzles extending transversely of the transport direction, and each bank extending in the transport direction. Successive printheads in the transport direction are used to print partial images which are accurately superimposed on one another to provide a full image having a greater number of inks than could be achieved using a single print head for the same print quality. For ease of illustration, as depicted in FIGS. 2 and 3, only one printhead 10, 11 is shown at the respective printing stations 26, 27. The printheads 10, 11 are mounted at different heights as determined by the heights of the spans 32, 36.

As described in greater detail with reference to FIG. 3, the printer includes an ink delivery system for supplying ink to the two printheads 10, 11. It will be understood that the ink delivery system includes a number of identical sub-systems 18, each dedicated to a respective one of a number of inks or other jettable fluids, such as primer. Each sub-system 18 can be considered as having a primary ink circulation circuit and a pair of secondary ink circulation circuits. FIG. 3 shows the ink delivery sub-system for one ink superimposed on an associated transport mechanism of the type described above, the transport mechanism shown in broken line.

Figure 4:
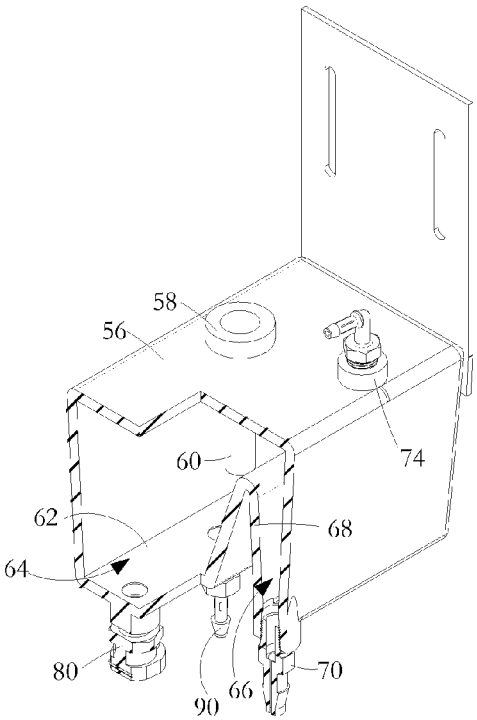
FIG. 4 is a perspective view with front face removed of an intermediate tank forming a part of an ink delivery system according to an embodiment of the invention.

Referring in detail to FIG. 3, the primary ink circulation circuit has a supply tank 40, a peristaltic pump 46, an upper intermediate tank 42 and a lower intermediate tank 44. Pump 46 is operated to pump ink up from the supply tank 40 into the intermediate tanks 42. The pump is run continuously while the printer is turned on, or often enough to keep the intermediate tanks 42, 44 fully charged with ink. The intermediate tanks 42, 44 are made of polypropylene and one exemplary form of intermediate tank is shown in perspective view with a front wall removed in FIG. 4.

The supply tank 40 has a flexible ink-filled plastic bottle 48 contained inside a corrugated cardboard box 50 which provides structural support for the bottle 48.

A delivery tube 52 connects the supply tank 40 to the peristaltic pump 46. As is known in the art, in a peristaltic pump, the pumping mechanism only touches the exterior of flexible tubing in which the ink flows. It does not contact the pumped ink itself, so preventing contamination of the ink in the ink delivery system. The pump 46 is run continuously or sufficiently often intermittently during printer operations whether at or between print cycles so as to keep the intermediate tanks 42, 44 full for supply of ink to the ink supply secondary circuit.

The upper intermediate tank 42 has a top wall 56 having a port 58 for receiving the end of the ink delivery tube 52, the port 58 also having a tube 60 extending down from the wall to a location close to the floor 62 of chamber 64. Although not shown in FIG. 4, the intermediate tank 42 has an associated filter mounted at port 58 for removing large particulates from ink delivered to the tank. Ink pumped through the delivery tube 52 enters the chamber 64 through the end of tube 60 at a location below the surface of the stored ink, so preventing splashing, foaming, or bubble formation. Maintaining the end of tube 60 at a relatively deep location ensures that ink pumped into the tank 42 is delivered to the bottom of a chamber 60 to encourage mixing with previously stored ink. Mixing of newly introduced ink with the stored ink reduces the chance of ink deteriorating owing to ink stagnation. The chamber 64 is separated from an adjacent overflow chamber 66 by an internal wall formation 68 which is integral with floor 62 and extends upwardly to a position just short of the top wall 56. The wall formation 68 operates as a weir so that once the depth of the ink in the chamber 64 reaches the height of the wall 68, additional ink pumped through delivery tube 52 escapes over the weir and accumulates in the bottom of chamber 66. The overflow ink escapes though a port 70 in the floor 62 and flows under gravity through a transfer tube 72. An ink overflow vent 74 is mounted in the top wall 56 of the tank 42. It is desirable to operate the pump 46 to have a gentle flow over the wall formations 68 both to maintain the ink at the intended level and to keep the ink fresh by recirculating through the system.

The lower intermediate tank 44 is structurally identical to the upper tank 42. As part of the primary circuit, overflow ink from the upper tank 42 flows through the transfer tube 72 and enters the lower tank 44 through port 58. In a process similar to that occurring at the upper tank 42, the overflow ink fills the chamber 64 to the height of the wall formation 68 and then flows over into the chamber 66. The chamber 66 of the lower tank 44 has a port 70 in the floor 62 through which overflow ink from the lower tank 44 enters a primary circuit return tube 76 and is returned to the respective supply tank 40 under the action of gravity. The lower tank also includes an overflow vent 74 in its top wall 56.

The secondary ink circulation circuits are used respectively to deliver ink from the upper intermediate tank 42 to the inkjet printhead 10 and from the lower intermediate tank 44 to the inkjet printhead 11. The secondary circuits each have a peristaltic pump 88 which is used to prime the respective printhead 10, 11. The secondary circuit for the top printhead 10 includes a tube 78 extending from an ink transfer port 80 in the floor of tank 42 to an entry port 84 in the printhead 10. The entry port 84 leads to a matrix of delivery channels (not shown) internal to the printhead 10 including a main supply channel for each ink extending from the entry port 84 to an exit port 82, and from which main channel multiple branch channels extend to nozzles at the printhead print face 86. Surfaces of the tubes/printhead channels have hydrophilic surfaces to ensure that the inks wet the surfaces in the interests of effective fluid dynamics. Ink exiting through the port 82 is returned through return line 77 to the intermediate tank 42 at port 90. The lower secondary circuit includes corresponding supply and return lines, respectively 79 and 81, between the lower intermediate tank 44 and the lower inkjet printhead 11, and operates in a manner similar to the upper secondary circuit. Peristaltic pumps 88 are used to charge the printheads 10, 11 for printing by drawing ink out of the intermediate tank 42, 44 at ports 80, through respective check valves 92, into the delivery channels of printheads 10, 11 and back to the intermediate tanks 42, 44 at ports 90. Once the printheads 10, 11 are charged, the peristaltic pumps 88 are then operated in reverse to force ink out to the printhead nozzles by pressurizing the line against the check valves 92. This operation acts to prime the printhead nozzles. The pumps 88 are normally switched off for the printing cycle. Successive printheads at the upper level can be connected into line 78, between 90 and 88, and line 78 between 80 and 92. Successive printheads at the lower level can analogously be connected into lines 81 and 79. FIG. 3 illustrates one such printhead connection 94, 95 for the go and return lines at each level. Each printhead would have its own peristaltic pump 88 and check valve 92 analogous to those illustrated for printheads 10 and 11.

In the course of printing at the upper printhead 10, ink is drawn by capillary action from the tank 42 into the printhead 10 acting against a precise negative hydrostatic pressure—i.e. suction—acting throughout the ink path extending between the tank 42 and the nozzles of the printhead 10. This hydrostatic pressure is a result of the difference in height, h, between the printhead print face 86, where the ink meniscus lies, and the surface of the ink in chamber 64. The negative pressure is established by arranging that the inkjet nozzles at the active surface of the printhead are higher than the level of ink in the chamber by a precise distance of, for instance, 80 mm as shown at "h". The negative pressure is sufficiently low as to recharge the printhead nozzles with ink as the ink is consumed during printing, but sufficiently high as to maintain the ink in the nozzles between ink jet firing at a nozzle so that ink does not leak onto the nozzle plate between instances of firing. It will be appreciated that the height difference between the printhead nozzles and the ink height in the intermediate tank 42 may vary between different commercial printheads, different environmental conditions such as altitude of printer installation, and will be determined by the density or other physical properties of the ink or other jettable fluid being printed. When not printing, the negative pressure is exactly balanced by capillarity developed in the fine channel of the associated printhead nozzle. The ink remains quiescent in the printhead branch channels until an electrical pulse is applied to a selected resistance heater to cause ink ejection through the associated nozzle. The ink that is expelled through the nozzle is almost instantly replaced by ink that is drawn up from the tank 42 through the associated inlet tube 78. The ink path from the tank 42 to the active face of the printhead 10 is closed to exclude air and so enable the siphoning action to take place. Capillarity in the printhead is sufficient to overcome the pressure difference represented by the 80 mm ink column and to suck ink into the channel until the balance condition exists. The size of the negative pressure maintained at the nozzles is critical to operation. If the negative pressure is too high, the meniscus at the nozzle breaks and air enters the head through the nozzles. If the pressure is too low, the ink can wick out onto the face of the printhead and destroy droplet formation. The check valves 92 are used to maintain ink in the respective secondary circuit in the event of a loss of the negative pressure. They also enable removal of one of the printheads 10, 11 without draining the ink supply lines to other printheads on that level. The drawing up of the ink by capillary action can be supplemented by low pressure continuous operation of the peristaltic pump 88 to pump ink from the associated intermediate tank. The pumping pressure of pump 88 must however be maintained at a low level to avoid disturbance to the ink priming in the printhead.

Although the embodiment of the invention described above is set in the context of duplex printing of cut sheets, it will be appreciated that an ink delivery system using the principles of the invention can be used to deliver ink to other inkjet printhead arrangements where one printhead (or bank of printheads) is at a different height to another printhead (or bank of printheads). In addition, the principles of the invention can be applied to a cascaded set of more than two printheads at different heights. Finally, the ink delivery system can be implemented on both web media and cut sheet media.

Other variations and modifications will be apparent to those skilled in the art. The embodiments of the invention described and illustrated are not intended to be limiting. The principles of the invention contemplate many alternatives having advantages and properties evident in the exemplary embodiments.

What is claimed is:

1. An ink jet printer having an ink delivery system comprising an ink supply tank;

first and second inkjet printheads located at different heights;

first and second intermediate tanks located at different heights respectively below the heights of the first and second inkjet printheads;

a pump for pumping ink from the supply tank into the first intermediate tank;

a first level setting device for limiting ink pumped into the first intermediate tank to a first level and for directing additional ink pumped into the first intermediate tank to a first overflow region;

a first ink supply line for supplying ink from the first intermediate tank to a first inkjet printhead;

an ink transfer line for transferring the overflow ink under gravity from the first overflow region to the second intermediate tank; and a second ink supply line for supplying ink from the second intermediate tank to a second inkjet printhead;

the first and second inkjet printheads mounted in a sheet medium transport mechanism for presenting a first surface of the sheet medium to the first inkjet printhead and for presenting a reverse surface of the sheet medium to the second inkjet printhead.

2. An ink delivery system as claimed in claim 1, the level setting device comprising a weir in the first intermediate tank.

3. An ink delivery system as claimed in claim 1, the second intermediate tank having a second level setting device for limiting ink entering into the second tank through the ink transfer line to a second level and for directing additional ink entering the tank back to the supply tank.

4. An ink delivery system as claimed in claim 3, the second level being a predetermined height below the height of nozzles of the second printhead whereby to establish a predetermined negative pressure in ink contained in the second printhead nozzles.

5. An ink delivery system as claimed in claim 1, the first level being a predetermined height below the height of nozzles of the first printhead whereby to establish a predetermined negative pressure in ink contained in the first printhead nozzles.

6. An ink delivery system as claimed in claim 1, wherein the pump is a peristaltic pump.

7. An ink delivery system as claimed in claim 1, further comprising a first ink return line permitting ink flow from an exit port of the first printhead to the first intermediate tank, and a second ink return line permitting ink flow from an exit port of the second printhead to the second intermediate tank.

8. An ink jet printer having a plurality of the ink delivery systems as claimed in claim 1 forming a multi-ink delivery system, the first and second printheads being common to the plurality of ink delivery systems of said multi-ink system, each ink delivery system operable to feed to the printheads a respective one of a plurality of different inks, each ink delivery system feeding a respective subset of nozzles of the first and second inkjet printheads.

9. An ink jet printer as claimed in claim 1, the transport mechanism constraining media transported therethrough to an S-form locus the S-form locus having first and second generally horizontal spans for transporting the media successively in opposite direction with the media turned between the first and second spans, the first printhead positioned to print on media transported at the second span and the second printhead positioned to print on media transported at the first span.

10. An ink jet printer having an ink delivery system as claimed in claim 1, the printheads being one of a thermal drop-on-demand printhead and a piezoelectric drop-on-demand printhead.

11. A method of delivering ink to an inkjet printer comprising the steps of:

pumping ink from a supply tank to a first intermediate tank to establish a level of the ink in the first intermediate tank at a first height;

establishing an ink path between ink in the first intermediate tank and nozzles at a first inkjet printhead mounted at a second height to establish a predetermined negative pressure of the ink at the nozzles of the first printhead;

directing overflow ink entering the first intermediate tank into an overflow ink transfer path to direct overflow ink under gravity to a second intermediate tank and establishing a level of the ink in the second intermediate tank at a third height;

establishing an ink path between ink in the second intermediate tank and nozzles at a second inkjet printhead mounted at a fourth height to establish a predetermined negative pressure of the ink at the nozzles of the second inkjet print head;

feeding a sheet medium past the first inkjet printhead, operating the first printhead to print an image down onto one surface of the sheet medium, turning the sheet medium, feeding the sheet medium past the second inkjet printhead, and operating the second printhead to print an image down onto the reverse surface of the sheet medium.

12. A method as claimed in claim 11, further comprising pumping the ink from the supply tank to the first intermediate tank using a peristaltic pump.

13. A method as claimed in claim 11, further comprising directing overflow ink entering the second intermediate tank to an overflow ink transfer path to direct overflow ink under gravity back to the supply tank.

14. A method as claimed in claim 11, further comprising establishing the levels of the ink in the first and second intermediate tanks respectively at the first and third heights using respective weirs.

15. A method as claimed in claim 11, the method being performed on a plurality of inks to deliver the inks to successive ones of the first and second printheads at nozzles of the printheads dedicated to respective ones of the inks, the method in respect of each ink utilizing a supply tank, a first and second intermediate tank and related interconnection conduits unique to the respective ink.

* * * * *